United States Patent [19]

Neumann

[11] 4,301,633

[45] Nov. 24, 1981

[54] SHINGLE-TYPE BUILDING ELEMENT

[75] Inventor: Peter Neumann, Eschen, Liechtenstein

[73] Assignee: Isopag AG, Liechtenstein, Fed. Rep. of Germany

[21] Appl. No.: 87,978

[22] Filed: Oct. 25, 1979

[30] Foreign Application Priority Data

Apr. 30, 1979 [DE] Fed. Rep. of Germany ..... 2917516

[51] Int. Cl.[3] ..... E04D 3/35; E04D 3/365

[52] U.S. Cl. ..... 52/309.4; 52/540; 52/543; 52/560; 52/553

[58] Field of Search ..... 52/518, 519, 520, 530, 52/531, 539–543, 553, 309.4, 448, 560

[56] References Cited

U.S. PATENT DOCUMENTS

| | | | |
|---|---|---|---|
| 50,839 | 7/1865 | Osgood | 52/539 |
| 1,702,609 | 2/1929 | Lesher | 52/553 |
| 2,278,758 | 4/1942 | Arendt | 52/448 |
| 3,468,086 | 9/1969 | Warner | 52/540 |
| 3,511,008 | 5/1970 | Grems et al. | 52/520 |
| 4,078,349 | 3/1978 | Gantner | 52/540 |
| 4,095,383 | 6/1978 | Strobl | 52/309.7 |

FOREIGN PATENT DOCUMENTS

| | | | |
|---|---|---|---|
| 31082 | 7/1907 | Austria | 52/540 |
| 555051 | 3/1923 | France | 52/541 |
| 1355537 | 2/1964 | France | 52/309.4 |
| 11422 | 1/1924 | Netherlands | 52/453 |

*Primary Examiner*—James L. Ridgill, Jr.
*Attorney, Agent, or Firm*—Larson and Taylor

[57] ABSTRACT

The present invention relates to a shingle-type building element in form of several shingle-like surfaces placed side by side forming a joint-structure or a single shingle piece, comprising a form of a plate which in the right angular cross-section shows the upper member with a width b a height h and a wedge-shaped lower member with the wedge point, with a truncated side, in case of a wedge stump which is later connected at the ridge, or the upper member facing the top of the wall by which the wedge-shaped lower member is either in the cross-section a triangle ABC of which side AC is equal to the height h of the upper member and of which the side BC is smaller than half of width b or the extension is such that it shows in the cross-section a triangle ABC, and a polygon joint below which gives after the building elements are laid in the cross-section a right angular basic member, by which the upper member and the lower member is one unit made of the same or different materials, the upper member of the single-type surface or joint structure show cuts in order to achieve the shingle-type effect this is not the case with the lower member.

10 Claims, 11 Drawing Figures

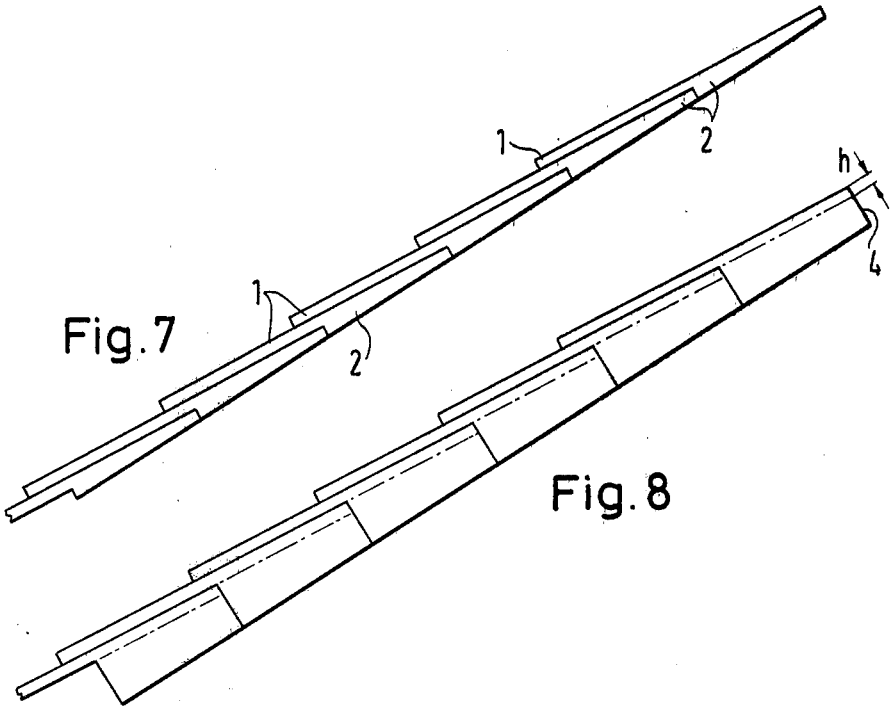
Fig. 7
Fig. 8
Fig. 9
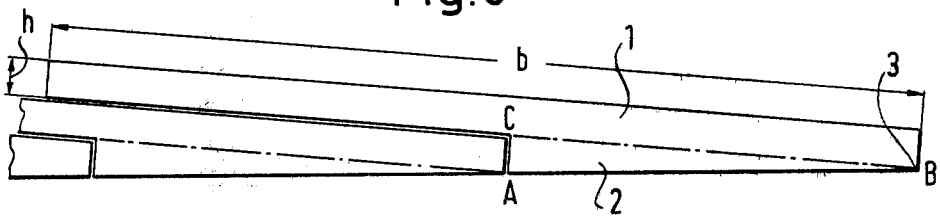
Fig. 10
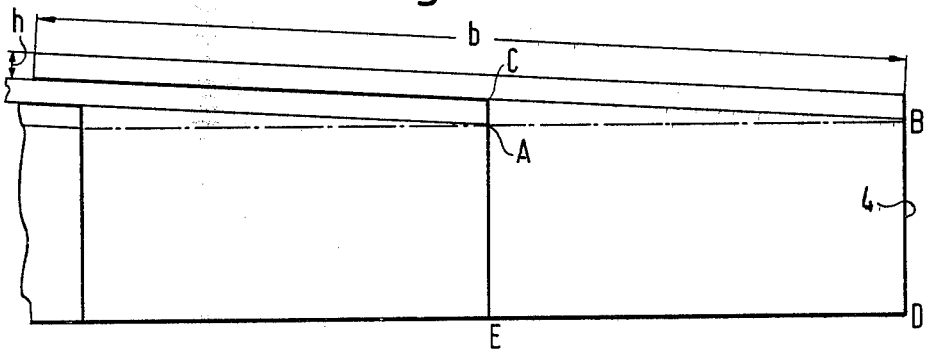

SHINGLE-TYPE BUILDING ELEMENT

The present invention relates to a shingle-type building element in form of several shingle-like surfaces placed side by side as a joint-structure or a single shingle piece.

Originally the term shingle meant a small piece of board that was split or torn, used for roofing or wall paneling. Today this term also describes a surface-structure comprising of other materials and formation which can be applied as a shingle-type roofing or wall paneling.

The shingles as well as the shingle-type surface-structure is nailed to a previously build wood casing. As a result an arrangement of shingles or shingle-type surface-structure is obtained as shown in FIG. 11. In normal roof-covering systems the shingles or shingle-type surface-structure is placed conditional, the bottom half lies flat, the top half in a linear position, thus creating a wedge-shaped hollow space beneath the shingles. The disadvantages associated with such a construction are obvious. For example the moist air and penetration of water into the hollow spaces, during the thaw period can lead to damage and eventually corrosion of the shingle materials, this is especially true of the ashphalt shingle-type surface-structure. Furthermore the danger exists that in the process of placing the shingle-type surface-structure the wedge-shaped hollow spaces could be damaged when walked on, or through high temperatures could contribute to deformation of the shingles, this does not only affect the performance of the shingle roofing but also has a negative influence on the appearance of the finished roof-service. It is clear that out of technical reasons no thick synthetic insulation material can be placed between the wood casing and the shingles or shingle-type surface-structure, therefore the only insulation possible is between the rafters, below the wood casing. This creates an uneven heat-barrier and it is necessary to place the insulation apart from the wood casing to ensure proper ventilation and to prevent dampness in the insulation and the wood casing.

The object of the present invention is to provide a shingle-type building element, the kind mentioned at the beginning which does not result in the outlined disadvantages of the shingles or shingle-type surface-structure and which in compliance with a preferred performance show additional insulation against cold and heat, it can be applied directly on the rafters or walls. The element is strong enough to walk on, and a wood casing or insulation are not necessary.

This is achieved by the present invention, the shingles or shingle-type surface-structure on the side that faces the ridge are placed on a wedge-shaped base corresponding to the hollow spaces shown in FIG. 11. The wedge-shaped lower member is preferably bonded to a wedge stump with an in the cross-section rectangular extension made of expanded plastic that stretches below the entire portion. The wedge-shaped lower member and the extension are preferably made of the same expanded plastic. The lower member and the extension are sprayed in one process to form a homogeneous unit.

Because of the invention of the wedge-shaped lower portion the shingles or shingle-type surface-structure lies completely flat on the base, by which at the beginning explained disadvantages such as the danger of breaking through the hollow spaces by walking on it especially when thin materials are used for example Eternit, or the changes through water condensation or heat impact will be avoided. The wedge-type lower portion in the cross-section preferably resembles a wedge stump made of expanded polyurethane plastic with an additional sectional reinforcing element that gives a layer of insulation and it makes it possible that in accordance with the invention shingle-type building element be nailed directly on the rafters.

This object is achieved by the present invention which is defined as a shingle-type building element in form of several shingle-like surfaces placed side by side, as a joint structure or a single shingle piece. The said element is identified in form of a plate in the cross-section with a rectangular upper member 1, the width b, the height h, and a wedge-shaped lower member 2 of which the point of wedge is 3, the truncated side of the wedge stump is 4 in case of a wedge stump that is later bonded at the ridge or the upper member 1 facing the top of the wall. The wedge-shaped lower member 2 is either in the cross-section a triangle ABC of which side AC equal the height h of the upper member 1 and of which side BC is smaller than half of the width b, or the extension is such that in the cross-section it shows a triangle ABC with a polygon located below, forming after the building element is laid in the cross-section a rectangular basic member, comprising of the upper member 1 and the lower member 2, combined as one unit and made of the same or different materials.

The upper member 1 of the shingle-type surface or joint-structure show cuts 5 for a shingle-like effect these cuts are not present in the lower member 2. In order to achieve the shingle-type effect after the in accordance with the invention shingle-type building elements are laid, it has been proven beneficial that the side BC of the lower member is approximately 1 to 5 cm shorter than half of width b.

As upper member all types of shingles or shingle plates which are available on the market can be used, regardless of what substance. The upper member consists of preferably ashphalt shingles or ashphalt plates. The lower member shows in the cross-section in form of a trapeze and it should consist of polyester preferably polyurethane. In accordance with the invention the lower member of the shingle-type building element is concealed with preferably aluminum foil, creating a sandwich construction (also known as a light core composite structure).

Sandwich construction is the name given to sectional elements, boards or threedimensional members consisting of strong, preferably thin or very thin, covering layers which are joined to a core layer of low specific weight and are supported thereby over a large area. The ability of the core of light material to support the covering layers is dependent upon its weight per unit volume and upon its bond with the covering layers. The preferred cores of light material, which also have a thermal insulating effect are made of expanded plastic materials, particularly expanded hard polyurethane, which can be produced in a very wide variety of weights per unit volume.

The hard expanded polyurethanes, particularly those based on polisocyanurate (expanded PIR) are therefore preferably used according to the invention. These expanded plastic materials preferably contain flame proofing additives, or use is made of such initial materials having flame-inhibiliting of flameprooving effect. Furthermore, these expanded plastic materials may contain considerable quantities of fillers, which may be based on finely divided mineral materials or in the form of wood-dust, so that compressive strength, for example, can be increased. It is also possible to use systems wherein, during the forming of the polymer, different reactions occur in parallel, for example the formation of polyurethane and the formation of polyester, the two systems being simultaneously linked by the unsaturated polyester which participate in the two reactions and contain resultant OH groups. The method of producing these products, particularly the expanded hard polyurethanes are well known to the expert in the field. For example reference may be made to Kunststoffe volume VII, Polyurethane, by Vieweg/Hochtlen (Karl Hanser-Verlag Munich 1966), in connection with the production of hard expanded polyurethanes.

The covering layers used for producing such sandwich constructions can likewise consist of any required material and can likewise be suitably profiled or left smooth to suit particular tastes. The covering layers may of course, be decorated in other ways; for example a wood-like appearance can be imparted to them. The sandwich construction can be produced on a intermittent or continnous basis, and for this purpose it is possible to use both the bonding method (also known as the "layup method" or the "sheating process") and the foam-in-situ method (also called "filling process"). According to the invention preference is given to the foam-in-situ-method, since it enables the core of expanded plastic material to be formed in a manner very well suited to the material.

According to the invention, such roof-sheeting elements are particularly preferred that are made of hard expanded polyurethane and which have an outer coating, preferably one made of "silverpaper" i.e. an aluminum foil lined with paper.

During the manufacturing process of the according to the invention shingle-type building element in form of a "sandwich construction" showed that the adhesion of the ashphalt shingles as upper member to the expanded plastics material is quite good but that additional fortification is favorable. Because the ashphalt shingles are easily broken it becomes necessary to weigh down a large surface of the ashphalt shingles, for example a nail-type peg with a large head is hammered into the upper member before the plastic is produced. It has been proven especially favorable that additional fortification of the upper member with the preferred polyurethane lower member is to place on the upper surface of the upper member a smooth strip of material and on the lower surface of the upper member a twisted strip of material, which are held together with a stable, which enclose simoultaneously, the upper strip and the lower strip, plus the twisted strip is embeded in the foam.

To further strengthen the in accordance with the invention shingle-type building element an alongated reinforcing element is embeded in said expanded plastic core comprising of sheet metal, shaped according to the invention in form of a preforated U-track with the lower side of the U resting on the lower member, its strength is such that even if not perforated the elements can easily be nailed directly to the rafters.

After the shingle-type building element in accordance with the invention is placed, the lower part of both of its longitudinal sides show a corresponding V-shaped indentation, tonge and groove. Of course one can think of other ways to join the element for example similar to this; in accordance with the invention preferred the longitudinal sides are cut on one narrow side to show a wedge-shaped extension and on the other side show a corresponding wedge-shaped indentation of which the base of the wedge is equal to the entire width of the building element.

In reference to the smooth strip of material on top of the upper member it can be mentioned that the texture of which be of any durable suitable material. According to the invention plastic strip, for example nylon strips, used to secure crates are preferred, the same is applicable for the twisted strip of material on the lower surface of the upper member but here a metal strip is preferred.

The invention will now be described in greater detail by reference to FIGS. 1 to 11, to which, however, the invention is not limited. A list of reference numerals used in the drawings can be found at the end of the description.

FIG. 7 is a cross-sectional view similar to FIG. 1 but showing schematically another embodiment of the invention.

FIG. 8 is a cross-sectional view similar to FIGS. 1 and 7 but showing still another embodiment of the invention.

FIG. 9 is an enlarged view of a portion of FIG. 7.

FIG. 10 is an enlarged view of a portion of FIG. 8.

Figure 1:
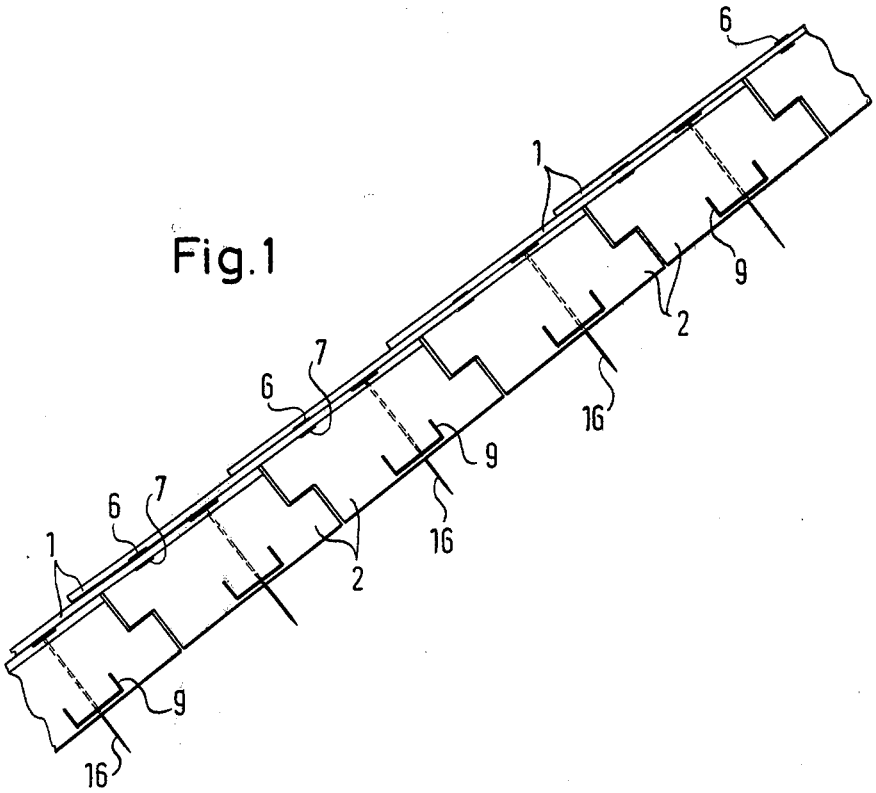
FIG. 1 is a cross-sectional view through a plurality of shingle elements forming a joint shingle structure in accordance with the present invention.

FIG. 1 shows a cross-section of part of a shingle roofing element that is arrived at in form of a row of preferred shingle-type building elements in accordance with the invention. These preferred building elements show a lower member 2 with on its longitudinal sides a stepped indentation extension, thus after the element is laid one arrives in the cross-section at a right-angular basic member, on top of which shows in the cross-section a wedge-shaped stump also referred to as a triangular part and on top of that rests the upper member 1, which is combined with the lower member 2 with the help of a smooth upper strip of material 6 and on the lower member 2 a securring strip in the form of a twisted strip of material 7 which is imbeded in the plastic. The lower member 2 shows a U-track 9, that serves as additional reinforcement, comprising of an accordingly bent sheet of metal which can be penetrated with nails, thus in accordance with the invention said element can be nailed directly to the rafters and walls.

Figure 2:
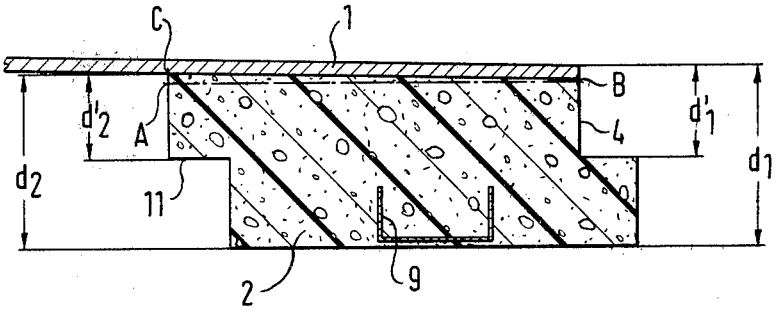
FIG. 2 shows on an enlarged scale a cross-section of one of the shingle elements of FIG. 1, with a portion of the element broken off.

FIG. 2 shows an enlarged cross-section of the said element as shown in FIG. 1 by which the upper member 1 is not illustrated in its full width. This enlargement shows the total height $d_1$ equal the height of the upper member 1 and the lower member 2, the same as the height $d_2$ of the lower member 2 as shown on the left side. Hence the lower member 2 forms in principal a truncated wedge of which 4 is the shorter side. In addition the lower member 2 has on its front and rear right angle indentations 11, the shape of which is such that the height $d_1$ equals height. After the building elements are laid one arrives in the cross-section at a rectangular basic member, on top of which is found a wedge that shows in the cross-section the triangle ABC.

Figure 3:
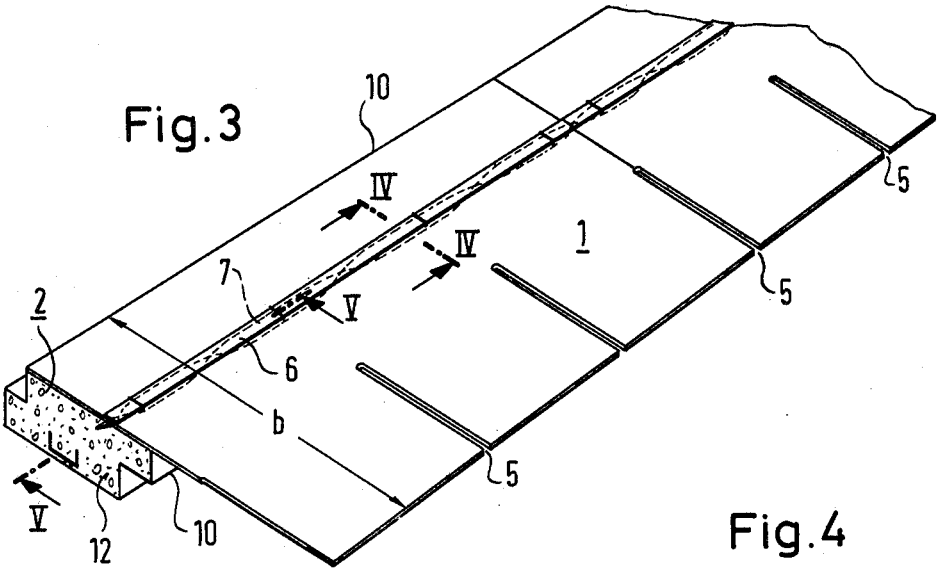
FIG. 3 is a perspective view of a portion of a shingle element.

FIG. 3 is a perspective illustration of the start of a preferable 4 m long shingle-type building element in accordance with the invention, the upper member 1 shows the shingle-type cuts 5 and the lower member 2 is illustrated as in FIG. 1 and 2, it shows on the upper surface of the upper member 1 a smooth strip of material 6.

Figure 4:
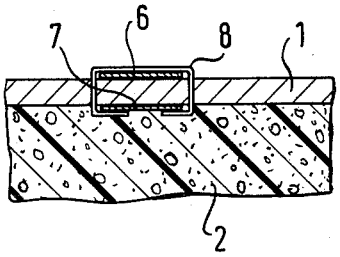
FIG. 4 is a partial cross-section view taken along line IV—IV of FIG. 3.

FIG. 4 shows the section A—A demonstrating how the smooth upper strip of material 6 which is located on the upper surface of the upper member 1 is held together with the twisted strip of material 7 with the help of a staple 8, as previously mentioned in FIG. 3.

Figure 5:
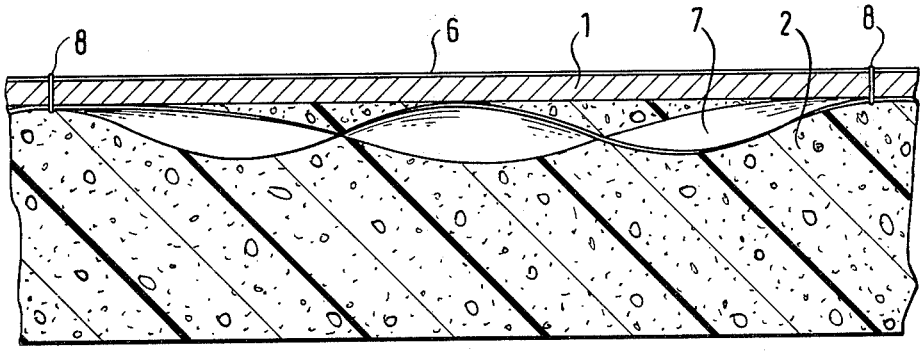
FIG. 5 is a partial cross-sectional view taken through the plane V—V of FIG. 3.

FIG. 5 shows section V—V of FIG. 3 whereby the smooth strip of material 6 is found on the upper surface of the upper member 1 and the twisted strip of material 7 which is embeded in the plastic is seen on the lower surface of the upper member 1 at first parts thereof, as previously mentioned in FIG. 3. On each completed twist of strip 7 it is held together with strip 6 to the upper member 1 with the help of a staple 8.

Figure 6:
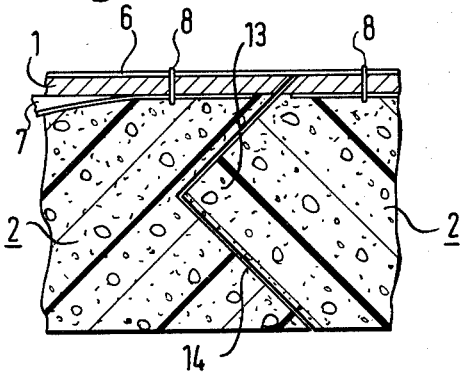
FIG. 6 is a partial cross-sectional view, also taken in a plane V—V of FIG. 3, but showing adjoining portions of two separate shingle elements.

FIG. 6 shows a cross-section in accordance with the invention the preferred wedge-type connection of two shingle-type building elements, on their front to back sides side a truncated wedge stump 14. Due to the wedge-shaped connection the 4 m long said elements can be pushed together between the rafters in a longitudinal direction without loosing its strength to walk on. For example should one step on the right side of the left building element in that case the pressure is transferred from the upper part of the wedge-shaped groove 14 to the upper part of the wedge-shaped tongue 13. Alternatively should one step on the left side of the right building element the pressure is transferred from the lower part of the wedge-shaped tongue 13 to the lower part of the wedge-shaped groove 14.

FIG. 7 shows in the cross-section part of a shingle-type roofing element in accordance with the invention after it is applied as demonstrated in FIG. 9.

FIG. 8 shows in the cross-section part of a shingle-type roofing after the shingle-type building elements are laid as illustrated in FIG. 10.

FIG. 9 shows facing oposite to FIG. 7 an enlarged cross-section of a shingle-type building element comprising of the upper member 1 and a wedge-shaped lower member 2. The upper member indicates the width band the height h. The wedge-shaped lower member referring in the cross-section a right angular triangle ABC with the right angle as point C. The point of the wedge 3 of the wedge-shaped lower member 2 shows in the cross-section at point B. The side AC of the right angled triangle ABC is equal to the height h of the upper member 1. These shingle-type building elements consists of preferably, in reference to the upper member 1 and the lower member 2 of the same substance, thus said elements are best suited for the conventional shingles which are normally laid on a previously build wood casing.

FIG. 10 shows a cross-section of a shingle-type building element as previously demonstrated in FIG. 8 in accordance with the invention preferred to the element shown in FIG. 9. This Fig. shows the basic member in accordance with the invention preferred shingle-type building element, it is preferred because with the wedge-shaped lower member 2, like it is clearly seen in FIG. 9 in addition the cross-section shows a right-angular extension below the triangle and together with the wedge-shaped part build a wedge stump with the truncated side of the wedge stump shown as 4. This basic form can be altered as already demonstrated in FIGS. 1–2 and and 3, the longitudinal side can be build with a V-shaped indentation 11.

Naturally the in the cross-section right angular extension could show other forms on its longitudinal sides for example a tonge and groove. It is also possible that in the cross-section the right angular extension form a parallelogram of which long edge is AB. In FIG. 10 the triangle ABC again is a right angular triangle with the right angle as point C. Because the right angular extension connects to the triangle side AB it formes as lower part a pentagon with points ABCDE. Of course the right angle of the triangle ABC can be point A, and in case of the upper member 1 facing torward the eaves or ridge it is cut according to the angle ABC. Through this it is arrived at that side CA is extended over A to E in a straight line, through which the lower member 2 takes the form in the cross-section of a trapezoid CBDE.

Figure 11:
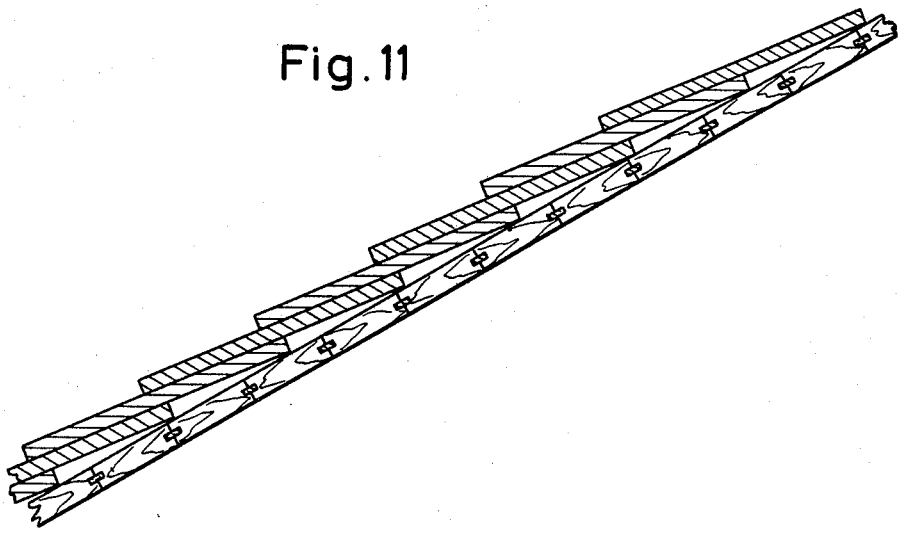
FIG. 11 is a cross-sectional view through a conventional prior art roof structure.

FIG. 11 shows a cross-section of part of a shingle roofing according to the prior art. A hollow wedge-shaped space is recognized below the shingles. The shingles are laid on a previously build wood casing.

LIST OF REFERENCE NUMERALS

I upper member
2 lower member
3 point of wedge
4 truncated side of wedge stump
5 shingle-like cuts
6 smooth strip of material
7 twisted strip of material
8 staple
9 sectional reinforcing element
10 longitudinal sides
11 V-shaped indentation
12 thrust side edges
13 wedge-shaped tonge
14 wedge-shaped groove
15 lower side of lower member 2
16 nail

What is claimed is:

1. A shingle type element of a shape which is adaptable to mate with other identical shingle elements to form a joint shingle structure, said element comprising:

an upper member having a width b in the front to rear direction and a height h, a lower member of an expanded plastic material, said lower member comprising an upper triangular part ABC with point B at the rear end of the upper member, side AC being on the front and equal in height to h, and wherein width b of the upper part is more than twice the length of line BC, said lower member including a lower part, the bottom of which is substantially parallel to line AB, a reinforcing element in the form of an elongated track embedded in the plastic material of the lower member and running generally perpendicular to the front to back direction thereof, and a securing means for securing together the upper and lower members, said securing means including:

a securing strip of material running along the bottom of the upper member, said securing strip having first parts fixed to the upper member, said strip having other parts extending down into the plastic material and embedded therein, such that at least some plastic material is present between some portions of the other part and the upper member to securely hold together the upper and lower members.

2. A shingle type element according to claim 1, wherein the plastic is hard expanded polyurethane.

3. A shingle type element according to claim 1 or claim 2, wherein the upper member is made of asphalt.

4. A shingle type element according to claim 1 or claim 2, said upper member having slits cut in the front thereof in order to achieve a shingle type appearance.

5. A shingle type element according to claim 1 or claim 2, wherein the lower member includes right angle steps in the front and back thereof, which steps are opposite to each other so that the front step of one lower member will mate with the back step of an adjacent lower member.

6. A shingle type element according to claim 1 or claim 2, wherein the front to back sides of the shingle type element include a V-shaped tongue on one side and a V-shaped groove on the opposite side, such that the V-shaped tongue will mate with the V-shaped groove of an adjacent, identical shingle type element.

7. A shingle type element according to claim 1 or claim 2, wherein the bottom of the lower member is covered with aluminum foil.

8. A shingle type element according to claim 1 or claim 2, wherein the upper member has a width b of 33 cm, a height h of approximately 3 to 5 mm and the line AB has a length of 14 to 15 cm and wherein the length of the shingle type element in the direction perpendicular to the front to back direction is approximately 400 cm.

9. A shingle type element according to claim 1 or claim 2, wherein said securing means comprises an upper strip of material on the top of the upper member, and the first part of said securing strip including parts located against the upper member and mechanically secured through the upper member to the upper strip, and said other parts of the securing strip including portions thereof which are twisted and which extend down into the plastic material.

10. A shingle type element according to claim 9, said reinforcing element comprising an upwardly concave perforated track extending along the lower member near the bottom thereof.

* * * * *

UNITED STATES PATENT AND TRADEMARK OFFICE

CERTIFICATE OF CORRECTION

PATENT NO. : 4,301,633

DATED : November 24, 1981

INVENTOR(S) : Peter Neumann

It is certified that error appears in the above—identified patent and that said Letters Patent is hereby corrected as shown below:

On the title page, Item (73) should read

-- Assignee: Isopag AG, Liechtenstein --.

Signed and Sealed this

*Eleventh* Day of *May 1982*

[SEAL]

*Attest:*

GERALD J. MOSSINGHOFF

*Attesting Officer*

*Commissioner of Patents and Trademarks*